US007926276B1

(12) United States Patent
Dunn

(10) Patent No.: US 7,926,276 B1
(45) Date of Patent: Apr. 19, 2011

(54) CLOSED CYCLE BRAYTON PROPULSION SYSTEM WITH DIRECT HEAT TRANSFER

(75) Inventor: Paul M. Dunn, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 07/926,116

(22) Filed: Aug. 7, 1992

(51) Int. Cl.
*F01K 25/02* (2006.01)

(52) U.S. Cl. ..... 60/682; 60/650

(58) Field of Classification Search ..... 60/682, 60/650, 39.461, 39.05, 39.02; 114/20.2
See application file for complete search history.

(56) References Cited

U.S. PATENT DOCUMENTS 3,101,592 A * 8/1963 Robertson et al. ..... 60/39.05
3,134,228 A * 5/1964 Wolansky et al. ..... 60/39.461
3,657,879 A * 4/1972 Ewbank et al. ..... 60/39.05
3,877,218 A * 4/1975 Nebgen ..... 60/39.05
4,228,659 A * 10/1980 Lowther ..... 60/682
4,275,562 A * 6/1981 Fejer ..... 60/682
4,680,934 A * 7/1987 Short ..... 114/20.2
5,107,682 A * 4/1992 Cosby ..... 60/682
5,117,635 A * 6/1992 Blau ..... 114/20.2
5,131,231 A * 7/1992 Trimble et al. ..... 60/650
5,177,952 A * 1/1993 Stone ..... 60/39.05

* cited by examiner

*Primary Examiner* — Christopher P Ellis
(74) *Attorney, Agent, or Firm* — James M. Kasischke; Michael P. Stanley; Jean-Paul A. Nasser

(57) ABSTRACT

A liquid metal fueled Brayton cycle power system with a direct contact heat exchanger. In this invention, a compressor compresses the working gas. A regenerator preheats the compressed working gas and passes the working gas to a reactor/storage tank with liquid metal fuel stored therein. An oxidant is injected into the reactor/storage tank to react with the liquid metal fuel. The compressed working gas bubbles through the liquid metal fuel in the reactor/storage tank and is heated by direct contact with the fuel-oxidant mixture. A turbine expands the heated working gas and thereby withdraws power from the system. The spent working gas exits to the regenerator where it warms the compressed gas. A cooler reduces the working gas temperature and recirculates the gas to the compressor.

12 Claims, 1 Drawing Sheet

CLOSED CYCLE BRAYTON PROPULSION SYSTEM WITH DIRECT HEAT TRANSFER

STATEMENT OF GOVERNMENT INTEREST

The invention described herein may be manufactured and used by or for the Government of the United States of America for Governmental purposes without the payment of any royalties thereon or therefor.

This patent application is copending with the related applications by the same inventor filed on the same date as subject patent entitled Closed Brayton Cycle Direct Contact Reactor/Storage Tank with Chemical Scrubber, Ser. No. 07/926,090, filed 7 Aug. 1992 Closed Brayton Cycle Direct Contact Reactor/Storage Tank with $O_2$ Afterburner, Ser. No. 07/926,200, filed 7 Aug. 1992 Semiclosed Brayton Cycle Power System with Direct Heat Transfer, Ser. No. 07/926,199, filed Aug. 7, 1992 and Semiclosed Brayton Cycle Power System with Direction Combustion Heat Transfer, Ser. No. 07/926,115, filed Aug. 7, 1992.

BACKGROUND OF THE INVENTION (1) Field of the Invention

The invention relates generally to non-air breathing power systems and, in particular, to a closed Brayton cycle propulsion system using direct heat transfer.

(2) Description of the Prior Art

Torpedoes and other underwater vehicles use propulsion systems having turbines powered by the reaction of an oxidant with a metal fuel in a liquid state, hereinafter referred to as liquid metal fuel, as a heat source. Lithium or another alkali metal is commonly used as liquid metal fuel with sulphur hexafluoride, $SF_6$, as the oxidant. A chlorofluorocarbon, such as $C_2F_3Cl_3$ known in the art as Freon-13, can also be used as the oxidant. Another possible liquid metal fuel is an aluminum-magnesium alloy with $O_2$ as the oxidant. Chlorofluorocarbons cannot be used with an aluminum-magnesium fuel because AlCl, one of the products of the reaction, is gaseous at operating temperatures.

Current underwater propulsion systems are typically closed Rankine cycle power systems utilizing lithium as a liquid metal fuel, a chlorofluorocarbon as an oxidant, and water as a working fluid. In a typical Rankine system, the working fluid is compressed, heated until vaporization, and then expanded through a turbine to produce power. Upon exiting the turbine, the low pressure vapor is condensed to a liquid, and the cycle is repeated. The working fluid is heated as it passes through heat transfer tubes that are wrapped to form a cylindrical annulus within the system's heat exchanger. Liquid metal fuel is contained in the center of the cylinder in order to heat the working fluid being carried by the heat transfer tubes. The working fluid, water, and the liquid metal fuel, lithium, react chemically with one another. A leak in the heat transfer tubes causes a violent reaction which generates a significant amount of heat and gas causing the heat exchanger and the underwater device to fail. Furthermore, should a leak occur in a land-based system, a toxic cloud of LiOH will be released into the environment. Other problems associated with the Rankine cycle include noise generation during the phase change of the working fluid, severe stress of the oxidant's injectors due to high reaction zone temperatures, and slow start-up time.

An alternative to the closed cycle Rankine system is the closed Brayton cycle system. In a Brayton cycle, there is no phase change and accordingly, no noise associated therewith. The Brayton cycle is also more efficient than the Rankine cycle despite the fact that more energy is required to compress a gas than to pump an equivalent mass of liquid. Prior art Brayton cycle systems cannot be used in underwater systems because the components of the closed Brayton cycle, principally the conventional Brayton heat exchanger, are too large to be used in the restricted space available in underwater vehicles.

A compact heat exchanger can be made by increasing gas velocity to achieve higher heat transfer coefficients; however, this results in greater heat exchanger pressure drop. This method is used successfully in the Rankine cycle since pump power is a small fraction of gross power (1/50) and pump losses are small by comparison. Accordingly, there is no significant reduction in cycle efficiency. In the Brayton cycle, however, compressor power is typically a large part of the gross power (1/2); therefore, small increases in gas velocity and heater pressure drop reduce the Brayton cycle efficiency below that of the Rankine cycle.

SUMMARY OF THE INVENTION

Accordingly, it is an object of the present invention to provide a closed Brayton cycle power system for use in an underwater vehicle propulsion system.

Another object of the present invention is to provide a closed Brayton cycle power system that utilizes a compact heat exchanger with low pressure drop.

Another object of the present invention is to provide a closed Brayton cycle power system that will propel an underwater vehicle for longer periods of time.

In accordance with the present invention, a liquid metal fueled Brayton cycle power system is used to power an underwater device. A compressor is provided to compress the working gas. The compressed working gas is then preheated in a regenerator and passed to a reactor/storage tank. Liquid metal fuel is stored within the reactor/storage tank. An oxidant is injected into the reactor/storage tank to react with the liquid metal fuel and thereby generate heat. The compressed working gas is bubbled through the liquid metal fuel/oxidant mixture and heated by direct contact. A turbine is provided for expanding the working gas and withdrawing power from the system. The working gas is cooled and recirculated.

BRIEF DESCRIPTION OF THE DRAWINGS

Other objects, features and advantages of the present invention will become apparent upon reference to the following description of the preferred embodiments and to the drawings, wherein.

DESCRIPTION OF THE PREFERRED EMBODIMENT

Figure 1:
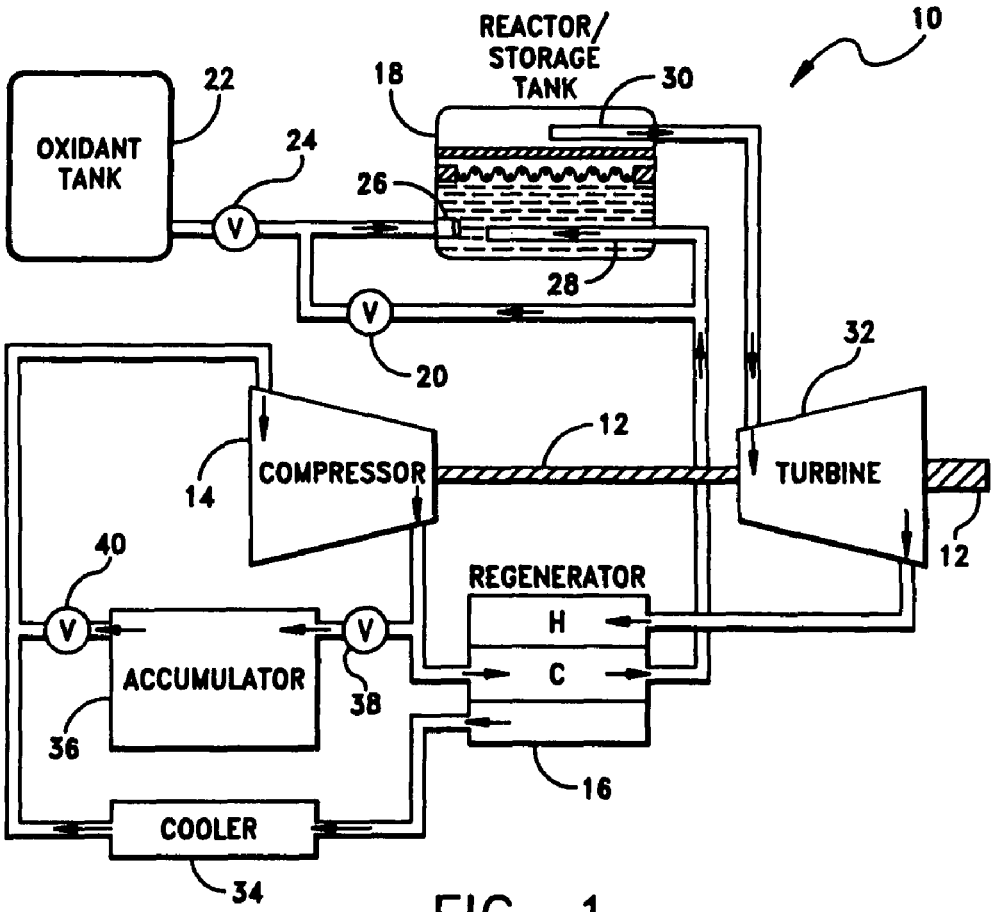
FIG. 1 is a schematic drawing depicting a closed Brayton cycle system.

Referring now to FIG. 1, there is shown a closed cycle Brayton propulsion system 10 used to turn a drive shaft 12. A compressor 14 driven by shaft 12 compresses a working gas. A regenerator 16 for preheating the working gas is placed in communication with the high pressure end of compressor 14. The output of regenerator 16 is operatively connected to carry the warmed gas to a reactor/storage tank 18 and an oxidant mixing valve 20. An oxidant storage tank 22 controlled by an oxidant control valve 24 is in communication with an injector 26 in reactor/storage tank 18. Injector 26 injects an oxidant into the reactor/storage tank where the oxidant reacts with the liquid metal fuel to produce heat. Oxidant mixing valve 20 acts to mix part of the warmed working gas with the oxidant to cool the temperature at injector 26.

Reactor/storage tank 18 is partially filled with liquid metal fuel. The warmed working gas enters reactor/storage tank 18 through working gas inlet tube 28 positioned below the surface of the liquid metal fuel in reactor/storage tank 18. A working gas outlet 30 is positioned in reactor/storage tank 18 above the surface of the liquid metal fuel. A turbine 32 is connected with working gas outlet 30 to receive the heated, high pressure, working gas.

Turbine 32 expands the working gas and mechanically transmits the extracted energy through drive shaft 12. Low pressure working gas from turbine 32 is transferred to regenerator 16 where the hot, low pressure working gas can transfer its heat to the cool, high pressure working gas passing from compressor 14 to reactor/storage tank 18. Low pressure gas exits from regenerator 16 and passes to a cooler 34 where the working gas is cooled by contact with the environment. In the preferred embodiment seawater is used to cool the working gas. Cool low pressure working gas is transported from cooler 34 to compressor 14.

An accumulator 36 having an accumulator input valve 38 and an accumulator output valve 40 is shown in communication between the compressor 14 output and input. Accumulator 36 can be initially filled with the working gas under pressure prior to initiation of the cycle. At start up, accumulator output valve 40 is opened to allow the working gas to enter the system. At any time during operation when the compressed working gas has higher pressure than the gas in accumulator 36, the power to the system can be reduced by opening accumulator input valve 38 and withdrawing working gas from the system.

Compressor 14 is mechanically connected to receive power from turbine 32 via drive shaft 12 mechanically connected to turbine 32. A drive means or other power consuming device can also be mechanically connected to receive power from drive shaft 12.

Figure 2:
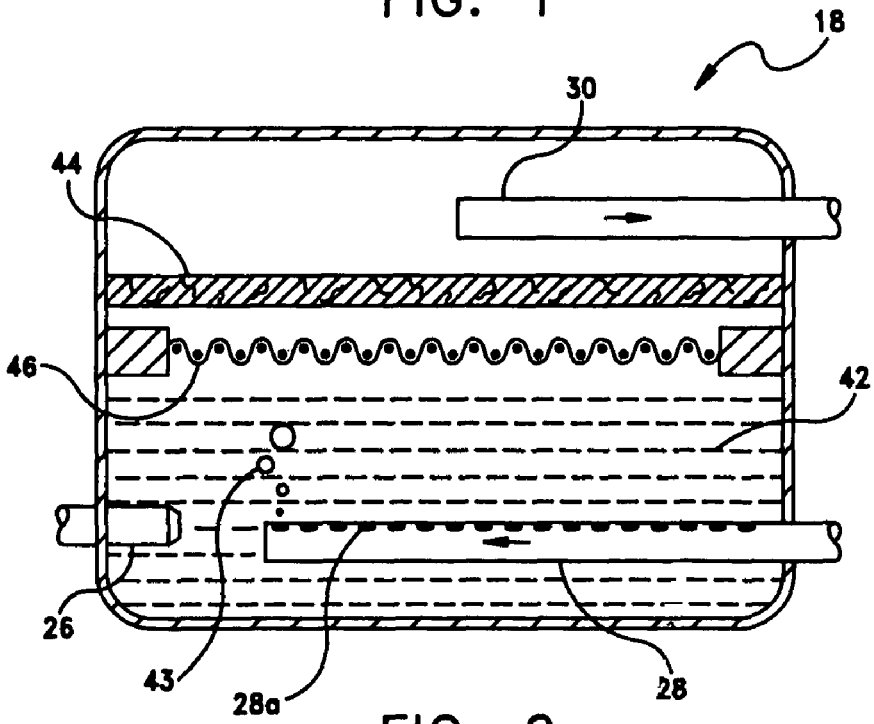
FIG. 2 is side sectional view of a direct contact reactor/storage tank configuration according to the present invention.

Referring now to FIG. 2, there is shown a detail view of the reactor/storage tank 18 of the current invention. Reactor/storage tank 18 is a tank partially filled with liquid metal fuel 42. Oxidant injector 26 and working gas inlet tube 28 are disposed below the surface of liquid metal fuel 42. Oxidant injector 26 is preferably made from tungsten. Working gas inlet 28 is a tube with a plurality of apertures 28*a* along the length thereof to disperse the working gas evenly through liquid metal fuel 42. Representative working gas bubbles 43 are shown leaving aperture 28*a* and expanding toward the surface of liquid metal fuel 42. Working gas outlet 30 is disposed above the surface of liquid metal fuel 42. A filter 44 and a screen 46 are disposed above the surface of fuel 42 between working gas outlet 30 and the surface. Filter 44 and screen 46 cover the entire surface of the fuel to prevent fuel and contaminants from entering working gas outlet 30. Screen 46 is typically stainless steel or another refractory metal. Filter 44 is typically a ceramic fiber insulation filter.

The preferred fuel is an aluminum-magnesium alloy. The oxidant in the preferred embodiment is $O_2$, and the preferred working gas is a mixture of helium, and xenon. The mixture of helium and xenon is preferred because of its heat transfer characteristics; however, argon is frequently substituted for the helium-xenon mixture for economic reasons. The working gas used should have a molecular weight of 20 to 50 grams/mole and be chemically inert with respect to the oxidant and fuel. The selected percentage of helium, argon and xenon used is dependent upon several factors including machinery size, pressure drop in reactor/storage tank 18 versus heat transfer, and performance capabilities of regenerator 16 and cooler 34.

The pressure of the inert gas mixture must be low enough to allow sufficient dwell time for proper heat transfer and to minimize splashing of liquid metal fuel 42 at its surface.

In operation, after the metal fuel is heated to the liquid state, the working gas is ejected through working gas inlet 28 into reactor/storage tank 18 where the working gas bubbles through liquid metal fuel 42. Thus, heat is transferred directly from liquid metal fuel 42 to the working gas. The liquid metal fuel 42 is maintained at a bulk temperature slightly above the required turbine inlet temperature.

The oxidant is directly injected from oxidant tank 22 into liquid metal fuel 42 through oxidant injector 26. The oxidant is substantially consumed by reaction with liquid metal fuel 42, and, thus, little of the oxidant will exit through working gas outlet 30. The oxidant must be stored in oxidant tank 22 and supplied at a high pressure since the oxidant will not pass through compressor 14. The products of the reaction sink to the bottom of reactor/storage tank 18 where they will not interfere with combustion or the flow of working gas. Furthermore, the products of the liquid metal/oxidant reaction must provide substantially the same volume as the fuel alone.

Temperatures caused by the oxidizing reaction near injector 26 can be in excess of 8,000° F. To prevent excessive injector wear, the oxidant can be mixed with a portion of the working gas using oxidant mixing valve 20 before injection into reactor/storage tank 18 to reduce the injection plume temperature.

The advantages of the present invention are numerous. Since the working gas and liquid metal fuel are inert with respect to each other, direct contact heating is made possible. Thus, heating efficiency is greatly increased over prior art devices which utilize heat transfer tubes coiled within a reactor. In addition, there is no danger of an explosive reaction between the working gas and the liquid metal fuel. Thus, the resulting closed Brayton cycle propulsion system is safer for the environment than the currently used lithium/water Rankine cycle system.

The working gas can be used to control the temperature of the liquid metal fuel at the injector. By reducing temperatures at the oxidizing agent injectors, the useful life of the system is increased and system cost is decreased. In addition, all noise associated with phase change is eliminated by using a closed Brayton cycle.

The invention disclosed herein may be practiced other than as specifically disclosed. For example, the accumulator can be omitted, the regenerator and cooler may differ structurally from those disclosed herein, and the inert gas/oxidant mixing system can be omitted if the injector can withstand the reactor temperatures.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A closed Brayton cycle power system for powering an underwater craft comprising:

a liquid metal fuel;

an oxidant chemically reactive with said liquid metal fuel;

a working gas chemically stable and inert with respect to said oxidant and said liquid metal fuel;

a reactor/storage tank containing said liquid metal fuel therein and having a working gas inlet and a working gas outlet, to allow said working gas to bubble through said liquid metal fuel, for heating said working gas by direct contact with said liquid metal fuel;

an oxidant supply tank for storing said oxidant therein at high pressure;

an injector disposed within said reactor/storage tank below the surface of said liquid metal fuel therein, said injector being in communication with said oxidant supply tank for injecting said oxidant into said liquid metal fuel;

a turbine having a turbine inlet and a turbine outlet, said turbine inlet being in communication with said working gas outlet of said reactor/storage tank for expanding said working gas and extracting power from said high pressure, high temperature working gas;

a regenerator having a hot side inlet, a hot side outlet, a cold side inlet, and a cold side outlet, said hot side inlet being in communication with said turbine outlet for receiving hot, expanded working gas from said turbine, said cold side outlet being in communication with said working gas inlet of said reactor/storage tank for preheating said compressed working gas;

a compressor having a compressor inlet and a compressor outlet, said compressor outlet being in communication with said cold side inlet of said regenerator for compressing said working gas;

a cooler having a cooler inlet and a cooler outlet, said cooler inlet being in communication with said hot side outlet from said regenerator, said cooler outlet being in communication with said compressor inlet; and a drive shaft mechanically connected to said turbine between said compressor for delivering power from said turbine to said compressor and said underwater device.

2. The device of claim 1 further comprising an injection gas mixing means interposed between said working gas inlet and said injector for mixing controlled portions of said working gas with said oxidant to lower the temperature at said injector.

3. The device of claim 2 further comprising:

an accumulator interposed between said compressor outlet and said compressor inlet for controlling the amount of working gas circulating in the system;

an accumulator inlet valve in communication between said accumulator and said compressor outlet, said accumulator inlet valve being positionable to allow compressed working gas to be withdrawn from said Brayton cycle power system; and an accumulator outlet valve in communication with said compressor inlet, said accumulator outlet valve being positionable to allow working gas to be added to said Brayton cycle power system.

4. The device of claim 3 wherein the reactor/storage tank further comprises:

a screen interposed between said liquid metal fuel and said working gas outlet for preventing particulate matter from entering said working gas outlet; and a filter interposed between said screen and said working gas outlet for removing liquid metal vapors and particulate matter from said heated working gas;

said working gas inlet extending below the surface of said liquid metal fuel in said reactor/storage tank and having a multiplicity of apertures therein along the length thereof for allowing said high pressure working gas to be dispersed through said liquid metal fuel.

5. The device of claim 4 wherein the working gas is a gas selected from a group consisting of argon, helium, neon, xenon and mixtures thereof with a molecular weight in the range of 20 to 50 grams/mole.

6. The device of claim 5 wherein the liquid metal fuel is an aluminum-magnesium alloy.

7. The device of claim 6 wherein the oxidant is $O_2$.

8. The device of claim 5 wherein the liquid metal fuel is an alkali metal.

9. The device of claim 8 wherein the oxidant is a chlorofluorocarbon.

10. A direct contact reactor/storage apparatus comprising:

a tank;

a liquid metal fuel contained within said tank;

an injector disposed in said housing below the surface of said liquid metal fuel;

an oxidant provided to said injector for injection into said liquid metal fuel;

an inlet bubbling tube having a multiplicity of apertures therethrough along the length thereof disposed below the surface of said liquid metal fuel in said reactor/storage tank;

a working gas provided to said inlet bubbling tube at high pressure for dispersion through said liquid metal fuel via said multiplicity of apertures in said inlet bubbling tube; and a working gas outlet disposed in said tank above the surface of said liquid metal fuel for allowing said heated working gas to exit said tank.

11. A direct contact reactor/storage apparatus as in claim 10 further comprising:

a screen interposed between said liquid metal fuel and said working gas outlet for preventing particulate matter from entering said working gas outlet; and a filter interposed between said screen and said working gas outlet for removing liquid metal vapors and particulate matter from said heated working gas.

12. A direct contact reactor/storage apparatus as in claim 11 wherein the working gas is a gas selected from a group consisting of argon, helium, neon, xenon and mixtures thereof with a molecular weight in the range of 20 to 50 grams/mole.

* * * * *